US007886392B2

(12) United States Patent
Wong et al.

(10) Patent No.: US 7,886,392 B2
(45) Date of Patent: Feb. 15, 2011

(54) METHOD OF SANITIZING A FABRIC LOAD WITH STEAM IN A FABRIC TREATMENT APPLIANCE

(75) Inventors: Nyik Siong Wong, St. Joseph, MI (US); Raveendran Vaidhyanathan, St. Joseph, MI (US); Anthony H. Hardaway, Stevensville, MI (US); Joel A. Luckman, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 660 days.

(21) Appl. No.: 11/464,507

(22) Filed: Aug. 15, 2006

(65) Prior Publication Data

US 2008/0040871 A1 Feb. 21, 2008

(51) Int. Cl.
*D06F 35/00* (2006.01)

(52) U.S. Cl. ..... 8/158; 8/149.3

(58) Field of Classification Search ..... 8/149.3, 8/158, 159

See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,778,212 | A | 1/1957 | Dayton et al. |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |
| 3,035,145 | A | 5/1962 | Rudolph |
| 3,060,713 | A | 10/1962 | Burkall |
| 3,223,108 | A | 12/1965 | Martz, Jr. |

(Continued)

FOREIGN PATENT DOCUMENTS

| | | | |
|---|---|---|---|
| CA | 1330526 | C | 7/1994 |

(Continued)

OTHER PUBLICATIONS

Translation of Dober et al. EP 1275767 A1, Jan. 2003.*

(Continued)

*Primary Examiner*—Michael Barr
*Assistant Examiner*—David Cormier
(74) *Attorney, Agent, or Firm*—Clifton G. Green; McGarry Bair PC

(57) ABSTRACT

A fabric treatment appliance, such as a washing machine, comprises at least one of a tub and drum configured to hold a fabric load. A method of operating the fabric treatment appliance comprises heating the fabric load and, after heating the fabric load, sanitizing the fabric load by heating the fabric load with steam.

22 Claims, 6 Drawing Sheets

U.S. PATENT DOCUMENTS

| | | | | |
|---|---|---|---|---|
| 3,234,571 | A | 2/1966 | Buss | |
| 3,347,066 | A | 10/1967 | Klausner | |
| 3,498,091 | A | 3/1970 | Mason | |
| 3,550,170 | A | 12/1970 | Davis | |
| 3,697,727 | A | 10/1972 | Neuman et al. | |
| 3,707,855 | A | 1/1973 | Buckley | |
| 3,712,089 | A | 1/1973 | Toth | 68/210 |
| 3,801,077 | A | 4/1974 | Pearson | |
| 3,830,241 | A | 8/1974 | Dye et al. | |
| 3,869,815 | A | 3/1975 | Bullock | |
| 3,890,987 | A | 6/1975 | Marcussen et al. | |
| 3,935,719 | A | 2/1976 | Henderson | |
| 4,020,396 | A | 4/1977 | Gambale et al. | |
| 4,034,583 | A | 7/1977 | Miessler | 68/16 |
| 4,045,174 | A | 8/1977 | Fuhring et al. | |
| 4,108,000 | A | 8/1978 | Norris | |
| 4,177,928 | A | 12/1979 | Bergkvist | |
| 4,207,683 | A | 6/1980 | Horton | 34/60 |
| 4,214,148 | A | 7/1980 | Fleischauer | |
| 4,263,258 | A | 4/1981 | Kalasek | |
| 4,332,047 | A | 6/1982 | Kuttelwesch | 8/158 |
| 4,373,430 | A | 2/1983 | Allen | |
| 4,386,509 | A | 6/1983 | Kuttelwesch | 68/20 |
| 4,432,111 | A | 2/1984 | Hoffmann et al. | 8/158 |
| 4,489,574 | A * | 12/1984 | Spendel | 68/16 |
| 4,496,473 | A * | 1/1985 | Sanderson | 252/186.41 |
| 4,527,343 | A | 7/1985 | Danneberg | |
| 4,646,630 | A | 3/1987 | McCoy et al. | |
| 4,761,305 | A | 8/1988 | Ochiai | |
| 4,777,682 | A | 10/1988 | Dreher et al. | 8/158 |
| 4,784,666 | A | 11/1988 | Brenner et al. | 8/137 |
| 4,809,597 | A | 3/1989 | Lin | |
| 4,879,887 | A | 11/1989 | Kagi et al. | 68/16 |
| 4,920,668 | A | 5/1990 | Henneberger et al. | |
| 4,987,627 | A | 1/1991 | Cur et al. | 8/158 |
| 4,991,545 | A | 2/1991 | Rabe et al. | |
| 5,032,186 | A | 7/1991 | Childers et al. | 134/25 |
| 5,050,259 | A | 9/1991 | Tsubaki et al. | 8/159 |
| 5,052,344 | A | 10/1991 | Kosugi et al. | |
| 5,058,194 | A | 10/1991 | Violi | |
| 5,063,609 | A | 11/1991 | Lorimer | |
| 5,107,606 | A | 4/1992 | Tsubaki et al. | 34/133 |
| 5,146,693 | A | 9/1992 | Dottor et al. | 34/77 |
| 5,152,252 | A | 10/1992 | Bolton et al. | |
| 5,154,197 | A | 10/1992 | Auld et al. | |
| 5,172,654 | A | 12/1992 | Christiansen | |
| 5,172,888 | A | 12/1992 | Ezekoye | |
| 5,199,455 | A | 4/1993 | Dlouhy | |
| 5,212,969 | A | 5/1993 | Tsubaki et al. | 68/19.2 |
| 5,219,370 | A | 6/1993 | Farrington et al. | |
| 5,219,371 | A | 6/1993 | Shim et al. | 8/149 |
| 5,279,676 | A | 1/1994 | Oslin et al. | |
| 5,291,758 | A | 3/1994 | Lee | 68/196 |
| 5,293,761 | A | 3/1994 | Jang | 68/15 |
| 5,315,727 | A | 5/1994 | Lee | 8/159 |
| 5,345,637 | A | 9/1994 | Pastryk et al. | 8/158 |
| 5,570,626 | A | 11/1996 | Vos | |
| 5,619,983 | A | 4/1997 | Smith | |
| 5,727,402 | A | 3/1998 | Wada | |
| 5,732,664 | A | 3/1998 | Badeaux, Jr. | |
| 5,743,034 | A | 4/1998 | Debourg et al. | |
| 5,758,377 | A | 6/1998 | Cimetta et al. | |
| 5,768,730 | A | 6/1998 | Matsumoto et al. | |
| 5,815,637 | A | 9/1998 | Allen et al. | |
| 6,029,300 | A | 2/2000 | Kawaguchi et al. | |
| 6,067,403 | A | 5/2000 | Morgandi | 392/401 |
| 6,094,523 | A | 7/2000 | Zelina et al. | |
| 6,122,849 | A | 9/2000 | Kida et al. | |
| 6,161,306 | A | 12/2000 | Clodic | 34/321 |
| 6,178,671 | B1 | 1/2001 | Zwanenburg et al. | |
| 6,295,691 | B1 | 10/2001 | Chen | |
| 6,327,730 | B1 * | 12/2001 | Corbett | 8/158 |
| 6,434,857 | B1 | 8/2002 | Anderson et al. | |
| 6,451,066 | B2 | 9/2002 | Estes et al. | |
| 6,460,381 | B1 | 10/2002 | Yoshida et al. | |
| 6,585,781 | B1 | 7/2003 | Roseen | 8/149.1 |
| 6,622,529 | B1 | 9/2003 | Crane | |
| 6,647,931 | B1 | 11/2003 | Morgandi et al. | |
| 6,691,536 | B2 | 2/2004 | Severns et al. | |
| 6,772,751 | B2 | 8/2004 | Deuringer et al. | |
| 6,789,404 | B2 | 9/2004 | Kim et al. | |
| 6,823,878 | B1 | 11/2004 | Gadini | |
| 6,874,191 | B2 | 4/2005 | Kim et al. | |
| 6,889,399 | B2 | 5/2005 | Steiner et al. | 8/159 |
| 7,021,087 | B2 | 4/2006 | France et al. | |
| 7,096,828 | B2 | 8/2006 | Tippmann | |
| 7,290,412 | B2 | 11/2007 | Yang et al. | |
| 7,325,330 | B2 | 2/2008 | Kim et al. | |
| 7,404,304 | B2 | 7/2008 | Yang et al. | |
| 7,421,752 | B2 | 9/2008 | Donadon et al. | |
| 7,490,491 | B2 | 2/2009 | Yang et al. | |
| 7,490,493 | B2 | 2/2009 | Kim et al. | |
| 7,520,146 | B2 | 4/2009 | Kim et al. | |
| 7,600,402 | B2 | 10/2009 | Shin et al. | |
| 7,765,628 | B2 | 8/2010 | Wong et al. | |
| 2001/0032599 | A1 | 10/2001 | Fisher et al. | |
| 2003/0215226 | A1 | 11/2003 | Nomura et al. | |
| 2003/0226999 | A1 | 12/2003 | Hage | |
| 2004/0163184 | A1 | 8/2004 | Waldron et al. | |
| 2004/0187527 | A1 | 9/2004 | Kim et al. | 68/5 |
| 2004/0187529 | A1 | 9/2004 | Kim et al. | 68/207 |
| 2004/0200093 | A1 | 10/2004 | Wunderlin et al. | |
| 2004/0206480 | A1 | 10/2004 | Maydanik et al. | |
| 2004/0221474 | A1 | 11/2004 | Slutsky et al. | |
| 2004/0237603 | A1 | 12/2004 | Kim et al. | |
| 2004/0244432 | A1 | 12/2004 | Kim et al. | 68/5 |
| 2004/0244438 | A1 | 12/2004 | North | 68/23.2 |
| 2004/0255391 | A1 | 12/2004 | Kim et al. | 8/149 |
| 2005/0000031 | A1 | 1/2005 | Price et al. | |
| 2005/0028297 | A1 | 2/2005 | Kim et al. | |
| 2005/0034248 | A1 | 2/2005 | Oh et al. | 8/149 |
| 2005/0034249 | A1 | 2/2005 | Oh et al. | 8/159 |
| 2005/0034250 | A1 | 2/2005 | Oh et al. | 8/159 |
| 2005/0034487 | A1 | 2/2005 | Oh et al. | 68/5 |
| 2005/0034488 | A1 | 2/2005 | Oh et al. | 68/5 |
| 2005/0034489 | A1 | 2/2005 | Oh et al. | 68/5 |
| 2005/0034490 | A1 | 2/2005 | Oh et al. | 68/5 |
| 2005/0050644 | A1 | 3/2005 | Severns et al. | |
| 2005/0072382 | A1 | 4/2005 | Tippmann, Sr. | |
| 2005/0072383 | A1 | 4/2005 | Powell et al. | |
| 2005/0092035 | A1 | 5/2005 | Shin et al. | 68/275 |
| 2005/0132503 | A1 | 6/2005 | Yang et al. | 8/149 |
| 2005/0132504 | A1 | 6/2005 | Yang et al. | 8/159 |
| 2005/0132756 | A1 | 6/2005 | Yang et al. | 68/12.15 |
| 2005/0144734 | A1 | 7/2005 | Yang et al. | 8/149.3 |
| 2005/0144735 | A1 | 7/2005 | Yang et al. | 8/149.3 |
| 2005/0144737 | A1 | 7/2005 | Roepke et al. | |
| 2005/0205482 | A1 | 9/2005 | Gladney | |
| 2005/0220672 | A1 | 10/2005 | Takahashi et al. | |
| 2005/0223503 | A1 | 10/2005 | Hong et al. | 8/158 |
| 2005/0223504 | A1 | 10/2005 | Lee et al. | |
| 2005/0252250 | A1 | 11/2005 | Oh et al. | |
| 2005/0262644 | A1 | 12/2005 | Oak et al. | |
| 2006/0000242 | A1 | 1/2006 | Yang et al. | |
| 2006/0001612 | A1 | 1/2006 | Kim | |
| 2006/0005581 | A1 | 1/2006 | Banba | |
| 2006/0010613 | A1 | 1/2006 | Jeon et al. | |
| 2006/0010727 | A1 | 1/2006 | Fung | |
| 2006/0010937 | A1 | 1/2006 | Kim et al. | |
| 2006/0016020 | A1 | 1/2006 | Park | |
| 2006/0090524 | A1 | 5/2006 | Jeon et al. | |
| 2006/0096333 | A1 | 5/2006 | Park et al. | |
| 2006/0101586 | A1 | 5/2006 | Park et al. | |
| 2006/0101588 | A1 | 5/2006 | Park et al. | |

| | | | |
|---|---|---|---|
| 2006/0101867 | A1 | 5/2006 | Kleker |
| 2006/0107468 | A1 | 5/2006 | Urbanet et al. |
| 2006/0112585 | A1 | 6/2006 | Choi et al. |
| 2006/0117596 | A1 | 6/2006 | Kim et al. |
| 2006/0130354 | A1 | 6/2006 | Choi et al. |
| 2006/0137105 | A1 | 6/2006 | Hong et al. |
| 2006/0137107 | A1 | 6/2006 | Lee et al. |
| 2006/0150689 | A1 | 7/2006 | Kim et al. |
| 2006/0151005 | A1 | 7/2006 | Kim et al. |
| 2006/0151009 | A1 | 7/2006 | Kim et al. |
| 2006/0191077 | A1 | 8/2006 | Oh et al. |
| 2006/0191078 | A1 | 8/2006 | Kim et al. |
| 2006/0277690 | A1 | 12/2006 | Pyo et al. |
| 2007/0006484 | A1 | 1/2007 | Moschuetz et al. |
| 2007/0028398 | A1 | 2/2007 | Kwon et al. |
| 2007/0084000 | A1 | 4/2007 | Bernardino et al. |
| 2007/0101773 | A1 | 5/2007 | Park et al. |
| 2007/0107472 | A1 | 5/2007 | Kim et al. |
| 2007/0107884 | A1 | 5/2007 | Sirkar et al. |
| 2007/0125133 | A1 | 6/2007 | Oh et al. |
| 2007/0130697 | A1 | 6/2007 | Oh et al. |
| 2007/0136956 | A1 | 6/2007 | Kim et al. |
| 2007/0137262 | A1 | 6/2007 | Kim et al. |
| 2007/0169279 | A1 | 7/2007 | Park et al. |
| 2007/0169280 | A1 | 7/2007 | Kim et al. |
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283509 | A1 | 12/2007 | Wong et al. |
| 2007/0283728 | A1 | 12/2007 | Wong et al. |
| 2008/0006063 | A1 | 1/2008 | Ahn et al. |
| 2008/0019864 | A1 | 1/2008 | Savage et al. |
| 2008/0028801 | A1 | 2/2008 | Czyzewski et al. |
| 2008/0115740 | A1 | 5/2008 | You |
| 2009/0056034 | A1 | 3/2009 | Herkle et al. |
| 2009/0056036 | A1 | 3/2009 | Herkle et al. |
| 2009/0056762 | A1 | 3/2009 | Pinkowski et al. |

FOREIGN PATENT DOCUMENTS

| | | | |
|---|---|---|---|
| CN | 1664222 | A | 9/2005 |
| CN | 1962988 | A | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 176355 | | 10/1906 |
| DE | 243328 | | 2/1912 |
| DE | 283533 | | 4/1915 |
| DE | 317887 | | 1/1920 |
| DE | 427025 | C | 3/1926 |
| DE | 435088 | C | 10/1926 |
| DE | 479594 | C | 7/1929 |
| DE | 668963 | C | 12/1938 |
| DE | 853433 | C | 10/1952 |
| DE | 894685 | C | 10/1953 |
| DE | 1847016 | | 2/1962 |
| DE | 1873622 | | 6/1963 |
| DE | 2202345 | A1 | 8/1973 |
| DE | 2226373 | A1 | 12/1973 |
| DE | 2245532 | A1 | 3/1974 |
| DE | 7340082 | U | 5/1975 |
| DE | 2410107 | A1 | 9/1975 |
| DE | 2533759 | A1 | 2/1977 |
| DE | 3103529 | A1 | 8/1982 |
| DE | 3139466 | A1 | 4/1983 |
| DE | 3408136 | A1 | 9/1985 |
| DE | 3501008 | | 7/1986 |
| DE | 3627988 | A1 | 4/1987 |
| DE | 8703344 | U1 | 7/1988 |
| DE | 4116673 | A1 | 11/1992 |
| DE | 4225847 | A1 | 2/1994 |
| DE | 4413213 | A1 | 10/1995 |
| DE | 4443338 | C1 | 6/1996 |
| DE | 29707168 | U1 | 6/1997 |
| DE | 19730422 | A1 | 1/1999 |
| DE | 19736794 | | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 10028944 | A1 | 12/2001 |
| DE | 10035904 | A1 | 1/2002 |
| DE | 10039904 | A1 | 2/2002 |
| DE | 10043165 | A1 | 2/2002 |
| DE | 10312163 | A1 | 11/2003 |
| DE | 10260163 | A1 | 7/2004 |
| DE | 102005051721 | A1 | 5/2007 |
| DE | 102007023020 | B3 | 5/2008 |
| EP | 0043122 | A1 | 1/1982 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | A1 | 9/1988 |
| EP | 0284554 | A1 | 9/1988 |
| EP | 0287990 | | 10/1988 |
| EP | 0302125 | | 8/1989 |
| EP | 363708 | A2 | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | | 4/1997 |
| EP | 0785303 | A1 | 7/1997 |
| EP | 0808936 | | 11/1997 |
| EP | 0816550 | A1 | 1/1998 |
| EP | 0821096 | A1 | 1/1998 |
| EP | 0839943 | A1 | 5/1998 |
| EP | 1163387 | A1 | 12/2001 |
| EP | 1275767 | | 1/2003 |
| EP | 1275767 | A1 * | 1/2003 |
| EP | 1351016 | | 10/2003 |
| EP | 1411163 | | 4/2004 |
| EP | 1437547 | A2 | 7/2004 |
| EP | 1441059 | | 7/2004 |
| EP | 1441175 | A2 | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1507033 | A1 | 2/2005 |
| EP | 1529875 | | 5/2005 |
| EP | 1544345 | | 6/2005 |

| | | | |
|---|---|---|---|
| EP | 1548175 | | 6/2005 |
| EP | 1550760 | | 7/2005 |
| EP | 1555338 | | 7/2005 |
| EP | 1555339 | | 7/2005 |
| EP | 1555340 | | 7/2005 |
| EP | 1561853 | | 8/2005 |
| EP | 1584728 | | 10/2005 |
| EP | 1619284 | A1 | 1/2006 |
| EP | 1655408 | A1 | 5/2006 |
| EP | 1659205 | A2 | 5/2006 |
| EP | 1666655 | A2 | 6/2006 |
| EP | 1696066 | A2 | 8/2006 |
| EP | 1731840 | | 12/2006 |
| EP | 1746197 | A2 | 1/2007 |
| EP | 1783262 | A2 | 5/2007 |
| EP | 1813704 | A1 | 8/2007 |
| EP | 1813709 | A2 | 8/2007 |
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | A1 | 10/1976 |
| FR | 2525645 | A1 | 10/1983 |
| FR | 2581442 | A2 | 11/1986 |
| FR | 2688807 | A1 | 9/1993 |
| GB | 21286 | | 0/1898 |
| GB | 191010567 | A | 0/1911 |
| GB | 191010792 | A | 0/1911 |
| GB | 191022943 | A | 0/1911 |
| GB | 191024005 | A | 0/1911 |
| GB | 191103554 | A | 0/1911 |
| GB | 102466 | A | 12/1916 |
| GB | 285384 | A | 11/1928 |
| GB | 397236 | | 8/1933 |
| GB | 514440 | A | 11/1939 |
| GB | 685813 | | 1/1953 |
| GB | 799788 | | 8/1958 |
| GB | 835250 | | 5/1960 |
| GB | 881083 | | 11/1961 |
| GB | 889500 | A | 2/1962 |
| GB | 1155268 | A | 6/1969 |
| GB | 1331623 | | 9/1973 |
| GB | 1352955 | | 5/1974 |
| GB | 1366852 | A | 9/1974 |
| GB | 2219603 | A | 12/1989 |
| GB | 2309071 | A | 7/1997 |
| GB | 2348213 | | 9/2000 |
| GB | 10423 | | 11/2009 |
| GB | 21024 | | 2/2010 |
| JP | 35021275 | | 8/1950 |
| JP | 36023044 | | 9/1960 |
| JP | 36000067 | | 7/1961 |
| JP | 52146973 | | 12/1977 |
| JP | 54068072 | A | 5/1979 |
| JP | 57094480 | | 5/1982 |
| JP | 57094480 | | 6/1982 |
| JP | 57032858 | | 7/1982 |
| JP | 60138399 | A | 7/1985 |
| JP | 61128995 | | 6/1986 |
| JP | 62066891 | | 3/1987 |
| JP | 2049700 | A | 2/1990 |
| JP | 02161997 | | 6/1990 |
| JP | 02026465 | | 7/1990 |
| JP | 02198595 | | 8/1990 |
| JP | 2239894 | | 9/1990 |
| JP | 2242088 | A | 9/1990 |
| JP | 02267402 | | 11/1990 |
| JP | 03025748 | | 6/1991 |
| JP | 3137401 | A | 6/1991 |
| JP | 04158896 | | 6/1992 |
| JP | 4158896 | A | 6/1992 |
| JP | 05023493 | | 2/1993 |
| JP | 05115672 | A | 5/1993 |
| JP | 05146583 | | 6/1993 |
| JP | 05269294 | | 10/1993 |
| JP | 5346485 | A | 12/1993 |
| JP | 06123360 | | 5/1994 |
| JP | 08261689 | | 10/1996 |
| JP | 9133305 | A | 5/1997 |
| JP | 10235088 | A | 9/1998 |
| JP | 11047488 | A | 2/1999 |
| JP | 11164979 | | 6/1999 |
| JP | 11164980 | | 6/1999 |
| JP | 11226290 | | 8/1999 |
| JP | 2000176192 | | 6/2000 |
| JP | 2003019382 | | 1/2003 |
| JP | 2003093775 | | 4/2003 |
| JP | 2003311068 | | 11/2003 |
| JP | 2003311084 | | 11/2003 |
| JP | 2003320324 | | 11/2003 |
| JP | 2003326077 | | 11/2003 |
| JP | 2004061011 | | 2/2004 |
| JP | 2004121666 | | 4/2004 |
| JP | 2004167131 | | 6/2004 |
| JP | 2004298614 | | 10/2004 |
| JP | 2004298616 | | 10/2004 |
| JP | 2004313793 | | 11/2004 |
| JP | 2005058740 | | 3/2005 |
| JP | 2005058741 | | 3/2005 |
| JP | 2005177440 | | 7/2005 |
| JP | 2005177445 | | 7/2005 |
| JP | 2005177450 | | 7/2005 |
| JP | 2005192997 | | 7/2005 |
| JP | 2005193003 | | 7/2005 |
| JP | 2006109886 | | 4/2006 |
| JP | 2006130295 | A | 5/2006 |
| JP | 2004167131 | | 9/2007 |
| KR | 9319820 | | 9/1993 |
| KR | 1019950018856 | | 7/1995 |
| KR | 1019970011098 | | 3/1997 |
| KR | 1019970070295 | | 11/1997 |
| KR | 2019970039170 | | 7/1998 |
| KR | 200128631 | | 8/1998 |
| KR | 100146947 | | 10/1998 |
| KR | 20010015043 | | 2/2001 |
| KR | 10220010010111 | | 2/2001 |
| KR | 20040085509 | A | 10/2004 |
| KR | 20050017481 | A | 2/2005 |
| KR | 20060031165 | A | 4/2006 |
| WO | 9214954 | | 9/1992 |
| WO | 9307798 | A1 | 4/1993 |
| WO | 9319237 | A1 | 9/1993 |
| WO | 97/15709 | | 5/1997 |
| WO | 98/03175 | | 1/1998 |
| WO | 01/11134 | | 2/2001 |
| WO | 0174129 | A2 | 10/2001 |
| WO | 03/012185 | | 2/2003 |
| WO | 03012185 | A2 | 2/2003 |
| WO | 03057966 | | 7/2003 |
| WO | 2004/059070 | | 7/2004 |
| WO | 2004091359 | A2 | 10/2004 |
| WO | 2005001189 | A1 | 1/2005 |
| WO | 2005018837 | A1 | 3/2005 |
| WO | 2005115095 | | 12/2005 |
| WO | 2006001612 | | 1/2006 |
| WO | 2006009364 | A1 | 1/2006 |
| WO | 2006070317 | A1 | 7/2006 |
| WO | 2006090973 | | 8/2006 |
| WO | 2006091054 | | 8/2006 |
| WO | 2006091057 | A1 | 8/2006 |
| WO | 2006098571 | | 9/2006 |
| WO | 2006098572 | | 9/2006 |
| WO | 2006098573 | | 9/2006 |
| WO | 2006101304 | | 9/2006 |
| WO | 2006101312 | | 9/2006 |
| WO | 2006101336 | | 9/2006 |

| | | | |
|---|---|---|---|
| WO | 2006101336 | A1 | 9/2006 |
| WO | 2006101345 | | 9/2006 |
| WO | 2006101358 | | 9/2006 |
| WO | 2006101360 | | 9/2006 |
| WO | 2006101361 | | 9/2006 |
| WO | 2006101362 | | 9/2006 |
| WO | 2006101363 | | 9/2006 |
| WO | 2006101365 | | 9/2006 |
| WO | 2006101372 | | 9/2006 |
| WO | 2006101376 | | 9/2006 |
| WO | 2006101377 | | 9/2006 |
| WO | 2006101377 | A1 | 9/2006 |
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007004785 | A1 | 1/2007 |
| WO | 2007007241 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |
| WO | 2007058477 | A1 | 5/2007 |
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007116255 | A1 | 10/2007 |
| WO | 2007145448 | A2 | 12/2007 |
| WO | 2008004801 | A2 | 1/2008 |

OTHER PUBLICATIONS

V-Zug Ltd Washing Machine Adora SL; User Manual; V-Zug AG, CH-6301 Zug, 2004; V-Zug Ltd Industriestrasse 66, 6301 Zug, Tel. 041 767 67 67.

* cited by examiner

METHOD OF SANITIZING A FABRIC LOAD WITH STEAM IN A FABRIC TREATMENT APPLIANCE

BACKGROUND OF THE INVENTION

1. Field of the Invention

The invention relates to a method of sanitizing a fabric load with steam in a fabric treatment appliance.

2. Description of the Related Art

Some fabric treatment appliances, such as a washing machine, a clothes dryer, and a fabric refreshing or revitalizing machine, utilize steam generators for various reasons. The steam from the steam generator can be used to, for example, heat water, heat a load of fabric items and any water absorbed by the fabric items, dewrinkle fabric items, remove odors from fabric items, etc. The steam can also be employed for imparting heat to the fabric load to sanitize the fabric items whereby all or a portion of microorganisms, such as bacteria, fungi, and viruses, present on the fabric items are killed, removed, or otherwise rendered innocuous. However, sanitizing the fabric items with steam heat requires raising the temperature of the fabric items to a relatively high temperature, which can require a relatively large amount of energy. Therefore, it is desirable to sanitize fabric items with steam while consuming less energy.

SUMMARY OF THE INVENTION

The invention relates to a method of operating a fabric treatment appliance according to one embodiment of the invention comprising at least one of a tub and drum configured to hold a fabric load comprises heating the fabric load and, after heating the fabric load, sanitizing the fabric load by heating the fabric load with steam in such a way to reduce the energy consumed as compared to prior methods or systems.

As such, the sanitizing of the fabric load can occur immediately after the initial heating of the fabric load.

The sanitizing of the fabric load can comprise increasing a temperature of the fabric load to a predetermined temperature. The predetermined temperature is about 70° C. The sanitizing of the fabric load can further comprise maintaining the fabric load temperature at the predetermined temperature for a predetermined time. The predetermined time can be about 10 minutes.

The sanitizing of the fabric load can comprise heating the fabric load for a predetermined time. The predetermined time can be about 30 minutes.

The sanitizing of the fabric load can comprise rotating the at least one of the tub and drum. The rotating of the at least one of the tub and drum can occur during an introduction of steam into the at least one of the tub and drum. The rotating the at least one of the tub and drum can comprise tumbling the fabric load. The tumbling of the fabric load can comprise tumbling the fabric load in alternating directions.

The sanitizing of the fabric load can comprise subjecting the fabric load to a sanitizing agent.

The initial heating of the fabric load can comprise subjecting the fabric load to heated liquid. The method can further comprise extracting the heated liquid from the fabric load prior to sanitizing the fabric load.

In one embodiment, the heated liquid comprises water and detergent. The method can further comprise rinsing the fabric load with rinse liquid after the sanitizing of the fabric load. The method can further comprise extracting the rinse liquid from the fabric load.

In another embodiment, the heated liquid comprises rinse water.

The heated liquid can have a temperature within a range of about 25° C. to about 60° C. In one embodiment, the heated liquid temperature can be about 40° C.

The initial heating of the fabric load can comprise heating the fabric load to a first temperature above ambient temperature. The sanitizing of the fabric load can comprises heating the fabric load to a sanitization temperature greater than the first temperature. The sanitizing of the fabric load can further comprise maintaining the sanitization temperature for a predetermined time.

DESCRIPTION OF EMBODIMENTS OF THE INVENTION

Figure 1:
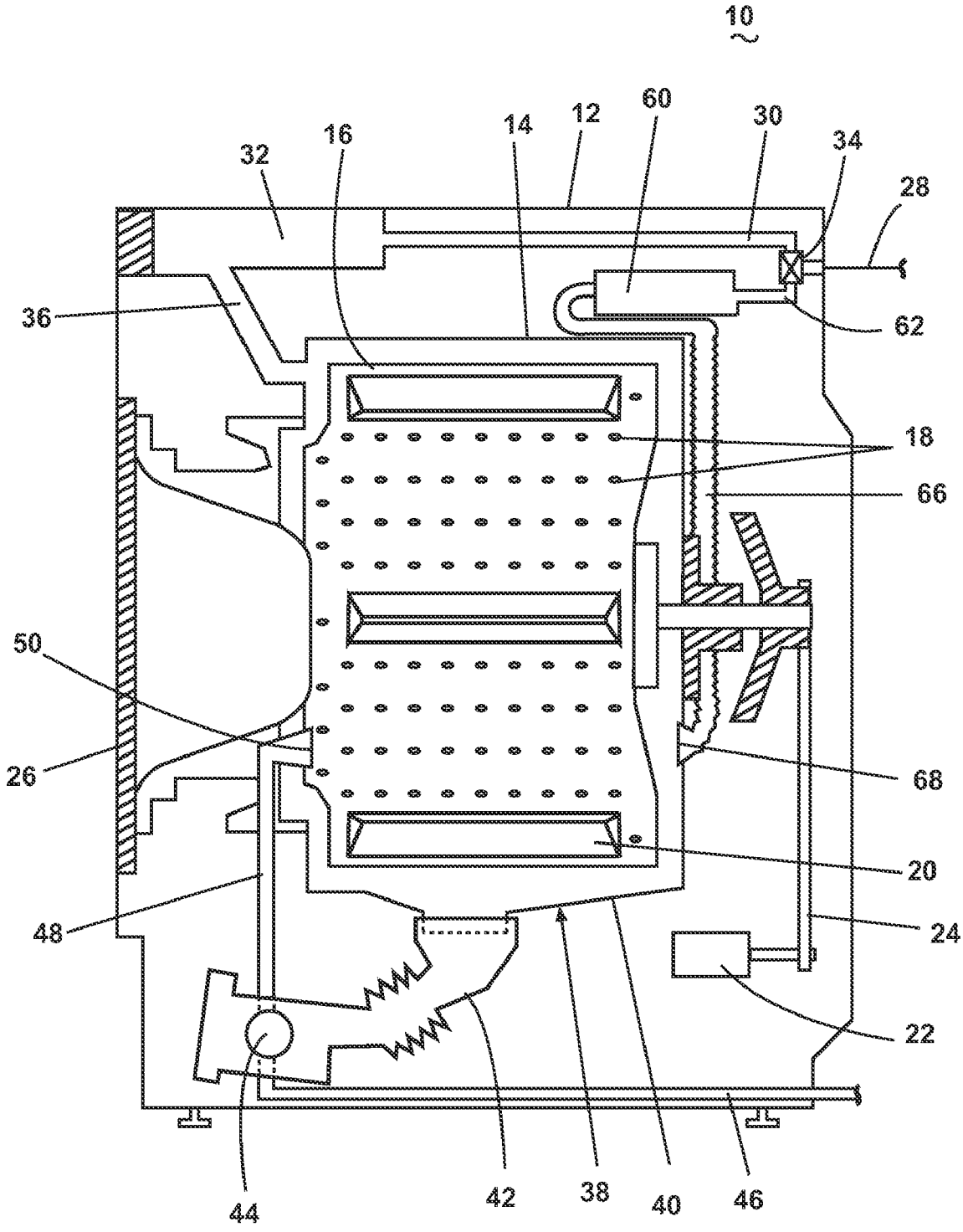
FIG. 1 is a schematic view of an exemplary fabric treatment appliance in the form of a washing machine according to one embodiment of the invention.

Referring now to the figures, FIG. 1 is a schematic view of an exemplary fabric treatment appliance in the form of a washing machine 10 according to one embodiment of the invention. The fabric treatment appliance can be any machine that treats fabrics, and examples of the fabric treatment appliance include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing machine; an extractor; a non-aqueous washing apparatus; and a revitalizing machine. For illustrative purposes, the invention will be described with respect to a washing machine, with it being understood that the invention can be adapted for use with any type of fabric treatment appliance having a steam generator.

The washing machine 10 of the illustrated embodiment comprises a cabinet 12 that houses a stationary tub 14. A rotatable drum 16 mounted within the tub 14 defines a fabric treatment chamber and includes a plurality of perforations 18, and liquid can flow between the tub 14 and the drum 16 through the perforations 18. The drum 16 further comprises a plurality of baffles 20 disposed on an inner surface of the drum 16 to lift fabric items contained in the drum 16 while the drum 16 rotates, as is well known in the washing machine art. A motor 22 coupled to the drum 16 through a belt 24 rotates the drum 16. Both the tub 14 and the drum 16 can be selectively closed by a door 26.

Washing machines are typically categorized as either a vertical axis washing machine or a horizontal axis washing machine. As used herein, the "vertical axis" washing machine refers to a washing machine comprising a rotatable drum, perforate or imperforate, that holds fabric items and a fabric moving element, such as an agitator, impeller, nutator, and the like, that induces movement of the fabric items to impart mechanical energy to the fabric articles for cleaning action. In some vertical axis washing machines, the drum rotates about a vertical axis generally perpendicular to a surface that supports the washing machine. However, the rotational axis need not be vertical. The drum can rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis. Vertical axis and horizontal axis machines are best differentiated by the manner in which they impart mechanical energy to the fabric articles. In vertical axis machines a clothes mover, such as an agitator, auger, impeller, to name a few, moves within a wash basket to impart mechanical energy directly to the clothes or indirectly through wash liquid in the wash basket. The clothes mover is typically moved in a reciprocating rotational movement. The illustrated exemplary washing machine of FIG. 1 is a horizontal axis washing machine.

The motor 22 can rotate the drum 16 at various speeds in opposite rotational directions. In particular, the motor 22 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the baffles 20. Typically, the force applied to the fabric items at the tumbling speeds is less than about 1 G. Alternatively, the motor 22 can rotate the drum 16 at spin speeds wherein the fabric items rotate with the drum 16 without falling. In the washing machine art, the spin speeds can also be referred to as satellizing speeds or sticking speeds. Typically, the force applied to the fabric items at the spin speeds is greater than or about equal to 1 G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The washing machine 10 of FIG. 1 further comprises a liquid supply and recirculation system. Liquid, such as water, can be supplied to the washing machine 10 from a household water supply 28. A first supply conduit 30 fluidly couples the water supply 28 to a detergent dispenser 32. An inlet valve 34 controls flow of the liquid from the water supply 28 and through the first supply conduit 30 to the detergent dispenser 32. The inlet valve 34 can be positioned in any suitable location between the water supply 28 and the detergent dispenser 32. A liquid conduit 36 fluidly couples the detergent dispenser 32 with the tub 14. The liquid conduit 36 can couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 enters a space between the tub 14 and the drum 16 and flows by gravity to a sump 38 formed in part by a lower portion 40 of the tub 14. The sump 38 is also formed by a sump conduit 42 that fluidly couples the lower portion 40 of the tub 14 to a pump 44. The pump 44 can direct fluid to a drain conduit 46, which drains the liquid from the washing machine 10, or to a recirculation conduit 48, which terminates at a recirculation inlet 50. The recirculation inlet 50 directs the liquid from the recirculation conduit 48 into the drum 16. The recirculation inlet 50 can introduce the liquid into the drum 16 in any suitable manner, such as by spraying, dripping, or providing a steady flow of the liquid.

The exemplary washing machine 10 further includes a steam generation system. The steam generation system comprises a steam generator 60 that receives liquid from the water supply 28 through a second supply conduit 62. The inlet valve 34 controls flow of the liquid from the water supply 28 and through the second supply conduit 62 to the steam generator 60. The inlet valve 34 can be positioned in any suitable location between the water supply 28 and the steam generator 60. A steam conduit 66 fluidly couples the steam generator 60 to a steam inlet 68, which introduces steam into the tub 14. The steam inlet 68 can couple with the tub 14 at any suitable location on the tub 14 and is shown as being coupled to a rear wall of the tub 14 in FIG. 1 for exemplary purposes. The steam that enters the tub 14 through the steam inlet 68 subsequently enters the drum 16 through the perforations 18. Alternatively, the steam inlet 68 can be configured to introduce the steam directly into the drum 16. The steam inlet 68 can introduce the steam into the tub 14 in any suitable manner.

The washing machine 10 can further include an exhaust conduit that directs steam that leaves the tub 14 externally of the washing machine 10. The exhaust conduit can be configured to exhaust the steam directly to the exterior of the washing machine 10. Alternatively, the exhaust conduit can be configured to direct the steam through a condenser prior to leaving the washing machine 10. Examples of exhaust systems are disclosed in the following patent applications, which are incorporated herein by reference in their entirety: Ser. No. 11/464,506, titled "Fabric Treating Appliance Utilizing Steam," Ser. No. 11/464,501, titled "A Steam Fabric Treatment Appliance with Exhaust," Ser. No. 11/464,521, titled "Steam Fabric Treatment Appliance with Anti-Siphoning," and Ser. No. 11/464,520, titled "Determining Fabric Temperature in a Fabric Treating Appliance," all filed concurrently herewith.

The steam generator 60 can be any type of device that converts the liquid to steam. For example, the steam generator 60 can be a tank-type steam generator that stores a volume of liquid and heats the volume of liquid to convert the liquid to steam. Alternatively, the steam generator 60 can be an in-line steam generator that converts the liquid to steam as the liquid flows through the steam generator 60. As another alternative, the steam generator 60 can comprise a heating element located in the sump 38 to heat liquid in the sump 38. The steam generator 60 can produce pressurized or non-pressurized steam.

Exemplary steam generators are disclosed in our Ser. No. 11/450,528, titled "Removal of Scale and Sludge in a Steam Generator of a Fabric Treatment Appliance," Ser. No. 11/450,836, titled "Prevention of Scale and Sludge in a Steam Generator of a Fabric Treatment Appliance," and Ser. No. 11/450,714, titled "Draining Liquid From a Steam Generator of a Fabric Treatment Appliance," all filed Jun. 9, 2006, in addition to Ser. No. 11/464,509, titled "Water Supply Control for a Steam Generator of a Fabric Treatment Appliance," Ser. No. 11/464,514, titled "Water Supply Control for a Steam Generator of a Fabric Treatment Appliance Using a Weight Sensor," and Ser. No. 11/464,513, titled "Water Supply Control for a Steam Generator of a Fabric Treatment Appliance Using a Temperature Sensor," all filed concurrently herewith, which are incorporated herein by reference in their entirety.

In addition to producing steam, the steam generator 60, whether an in-line steam generator, a tank-type steam generator, or any other type of steam generator, can heat water to a temperature below a steam transformation temperature, whereby the steam generator 60 produces hot water. The hot water can be delivered to the tub 14 and/or drum 16 from the steam generator 60. The hot water can be used alone or can optionally mix with cold water in the tub 14 and/or drum 16. Using the steam generator to produce hot water can be useful when the steam generator 60 couples only with a cold water source of the water supply 28.

The liquid supply and recirculation system and the steam generator system can differ from the configuration shown in FIG. 1, such as by inclusion of other valves, conduits, wash aid dispensers, and the like, to control the flow of liquid and steam through the washing machine 10 and for the introduction of more than one type of detergent/wash aid. For example, a valve can be located in the liquid conduit 36, in the recirculation conduit 48, and in the steam conduit 66. Furthermore, an additional conduit can be included to couple the water supply 28 directly to the tub 14 or the drum 16 so that the liquid provided to the tub 14 or the drum 16 does not have to pass through the detergent dispenser 32. Alternatively, the liquid can be provided to the tub 14 or the drum 16 through the steam generator 60 rather than through the detergent dispenser 32 or the additional conduit. As another example, the liquid conduit 36 can be configured to supply liquid directly into the drum 16, and the recirculation conduit 48 can be coupled to the liquid conduit 36 so that the recirculated liquid enters the tub 14 or the drum 16 at the same location where the liquid from the detergent dispenser 32 enters the tub 14 or the drum 16.

Other alternatives for the liquid supply and recirculation system are disclosed in Ser. No. 11/450,636, titled "Method of Operating a Washing Machine Using Steam;" Ser. No. 11/450,529, titled "Steam Washing Machine Operation Method Having Dual Speed Spin Pre-Wash;" and Ser. No. 11/450,620, titled "Steam Washing Machine Operation Method Having Dry Spin Pre-Wash," all filed Jun. 9, 2006, which are incorporated herein by reference in their entirety.

The washing machine 10 can further comprise a controller coupled to various working components of the washing machine 10, such as the pump 44, the motor 22, the inlet valve 34, the detergent dispenser 32, and the steam generator 60, to control the operation of the washing machine 10. The controller can receive data from the working components and can provide commands, which can be based on the received data, to the working components to execute a desired operation of the washing machine 10.

The washing machine of FIG. 1 is provided for exemplary purposes only. It is within the scope of the invention to perform the inventive method on other types of washing machines, examples of which are presented below.

A method of operating the washing machine 10 according to the invention comprises sanitizing a load of fabric items in the fabric treatment chamber, which, as described above, is defined by the drum 16 but can also or alternatively be defined by the tub 14 (e.g., if the washing machine 10 does not include the drum 16). As used herein, "sanitizing" refers to killing, removing, or otherwise rendering innocuous all or a portion of unsanitary microorganisms, such as bacteria, fungi, and viruses, present on the fabric items. The sanitizing process involves heating the fabric items, such as with steam from the steam generator 60, to increase a temperature of the fabric items to a sanitization temperature sufficiently high to sanitize the fabric items. The sanitization temperature can be an empirically determined temperature or can be a temperature set by a sanitization standard. An exemplary range for the sanitization temperature is from about 65° C. to about 70° C. Within this range, it has been determined that an exemplary suitable sanitization temperature is about 70° C.

According to one embodiment of the invention, the sanitization process occurs after the fabric items have been heated to a temperature less than the sanitization temperature as another step in the wash cycle. By conducting the sanitization process after a heating step in the wash cycle, less energy is consumed in the sanitization process because the temperature of the fabric items is already partially raised from the heating step. For example, heating the fabric items from a temperature above ambient temperature to the sanitization temperature requires less energy than heating the same fabric items from ambient temperature to the sanitization temperature.

The heating of the fabric items prior to the sanitization process can occur in any suitable manner, such as by subjecting the fabric items to heated liquid. The heated liquid can be, for example, the liquid associated with a conventional step in a wash process, such as a wash step, where the heated liquid typically comprises water and a wash aid (e.g., detergent), or a rinse step, where the heated liquid typically comprises water. The temperature of the heated liquid is above ambient temperature, and an exemplary range for the temperature of the heated liquid is from about 25° C. to about 60° C. Within this range, an exemplary suitable temperature for the heated liquid is about 40° C. Because the temperature of the heated liquid is above ambient temperature, the heated liquid raises the temperature of the fabric items above ambient temperature.

Figure 2:
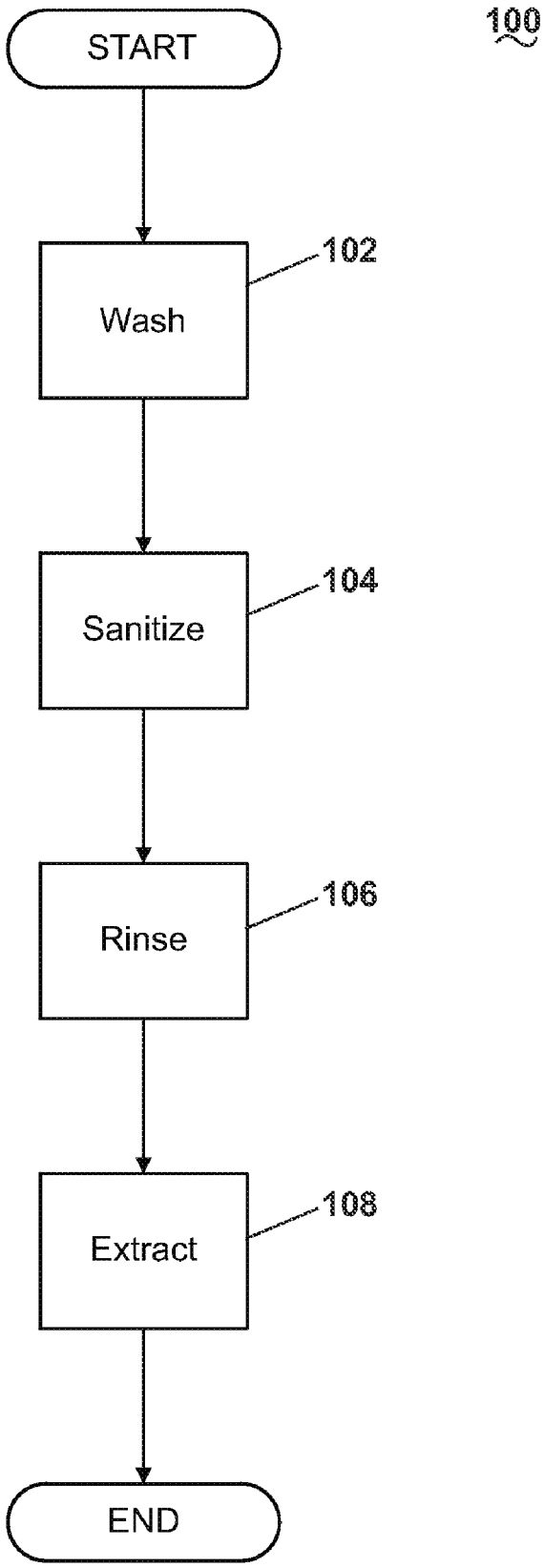
FIG. 2 is a flow chart of a method of operating the washing machine of FIG. 1 according to one embodiment of the invention, wherein the method includes a sanitization step.

Exemplary embodiments of the method of operating a washing machine with steam and involving sanitizing the fabric load are illustrated in FIGS. 2-6. Referring now to FIG. 2, an exemplary method 100 comprises a wash step 102, a sanitization step 104, a rinse step 106, and an extraction step 108. The wash step 102, the rinse step 106, and the extraction step 108 can be any suitable wash, rinse, and extraction steps 102, 104, 106, which are steps commonly included in a conventional wash cycle in a washing machine.

As an example, the wash step 102 can include submerging at least a portion of the drum 16 in a liquid comprising water and a wash aid, such as detergent, and rotating the drum 16 through the liquid to wash the fabric items. Alternatively, the wash step 102 can include spraying a liquid, such as the liquid comprising water and the wash aid, onto the fabric load while the drum 16 rotates. For a vertical axis washing machine, the wash step 102 can involve movement of the fabric moving element. Regardless of the type of wash step 102, the wash step 102 in the embodiment shown in FIG. 2 involves subjecting the fabric load to heated liquid to raise the temperature of the fabric load to above ambient temperature as described above. Furthermore, using the heated liquid in the wash step 102 improves the cleaning performance of the wash step 102. Optionally, the wash step 102 can end with draining the heated liquid from the tub 14 and spinning the drum 16 to remove excess heated liquid from the fabric load.

With continued reference to FIG. 2, the sanitization step 104 follows the wash step 102. While the sanitization step 104 can be any suitable step that subjects the fabric load to steam to raise the temperature of the fabric to near or above the sanitization temperature as described above, an exemplary sanitization step 104 is illustrated in the flow chart of FIG. 3.

The exemplary sanitization step 104 initiates with rotating the drum in step 110. According to one embodiment, the rotating of the drum corresponds to rotating the drum at a tumbling speed so that the fabric load tumbles in the drum 16. The drum 16 can rotate in alternating directions or in a single direction. Either after or when the drum 16 begins to rotate, steam is introduced into the tub 14 and/or the drum 16, such as by the steam generator 60, in step 112. The introduction of steam in the step 112 continues until the fabric load reaches a predetermined temperature, which corresponds to the sanitization temperature and can comprise continuously or intermittently introducing the steam. The temperature of the fabric load can be determined in any suitable manner, and an exemplary method of determining the fabric load temperature is described in the above-incorporated patent applications having Ser. No. 11/464,506, entitled Fabric Treating Appliance Utilizing Steam, Ser. No. 11/464,501 entitled A Steam Fabric Treatment Appliance With Exhaust, Ser. No. 464,521 entitled Fabric Treatment Appliance With Anti-Siphoning, and Ser. No 11/464,520 entitled Determining Fabric Temperature In A Fabric Treating Appliance all filed concurrently herewith.

Once the fabric load reaches the predetermined temperature, the temperature of the fabric load is maintained in step 114 for a predetermined time. The temperature can be maintained by continuously or intermittently introducing steam. Alternatively, the maintaining of the temperature can occur without any additional introduction of steam. The predetermined time can be an empirically determined time and is preferably sufficiently long to accomplish a desired sanitization level of the fabric load. The predetermined time can depend on several factors, including fabric type and load size. An exemplary range of suitable predetermined time is from about 5 minutes to about 15 minutes, and within this range, an exemplary suitable predetermined time has been determined to be about 10 minutes.

The drum 16 can continue to rotate during the step 114 of maintaining the predetermining temperature. The rotation of the drum 16 can be continuous, intermittent, in alternating directions, and/or in a single direction. After the predetermined time for maintaining the predetermined temperature expires, the drum rotation can cease immediately or after a period of time in step 116.

Referring back to FIG. 2, after the sanitization step 104, the method 100 continues with the rinse step 106. The rinse step 106 can include submerging at least a portion of the drum 16 in a rinse liquid, such as water, and rotating the drum 16 through the rinse liquid to rinse the liquid from the wash step 102 from the fabric items. Alternatively, the rinse step 106 can include spraying the rinse liquid onto the fabric load while the drum 16 rotates. For a vertical axis washing machine, the rinse step 106 can involve movement of the fabric moving element. Optionally, the rinse step 106 can end with draining the rinse liquid from the tub 14 and spinning the drum 16 to remove excess rinse liquid from the fabric load. The rinse step 106 can be repeated, if desired, to ensure removal of the liquid from the wash step 102.

Following the rinse step 106, the method 100 continues with the extraction step 108. During the extraction step 108, the drum 16 rotates at a spinning speed to extract excess rinse liquid from the fabric load. The spinning of the drum 16 can occur in any suitable manner, such as according to a spin profile that can include speed ramps and speed plateaus.

Figure 3:
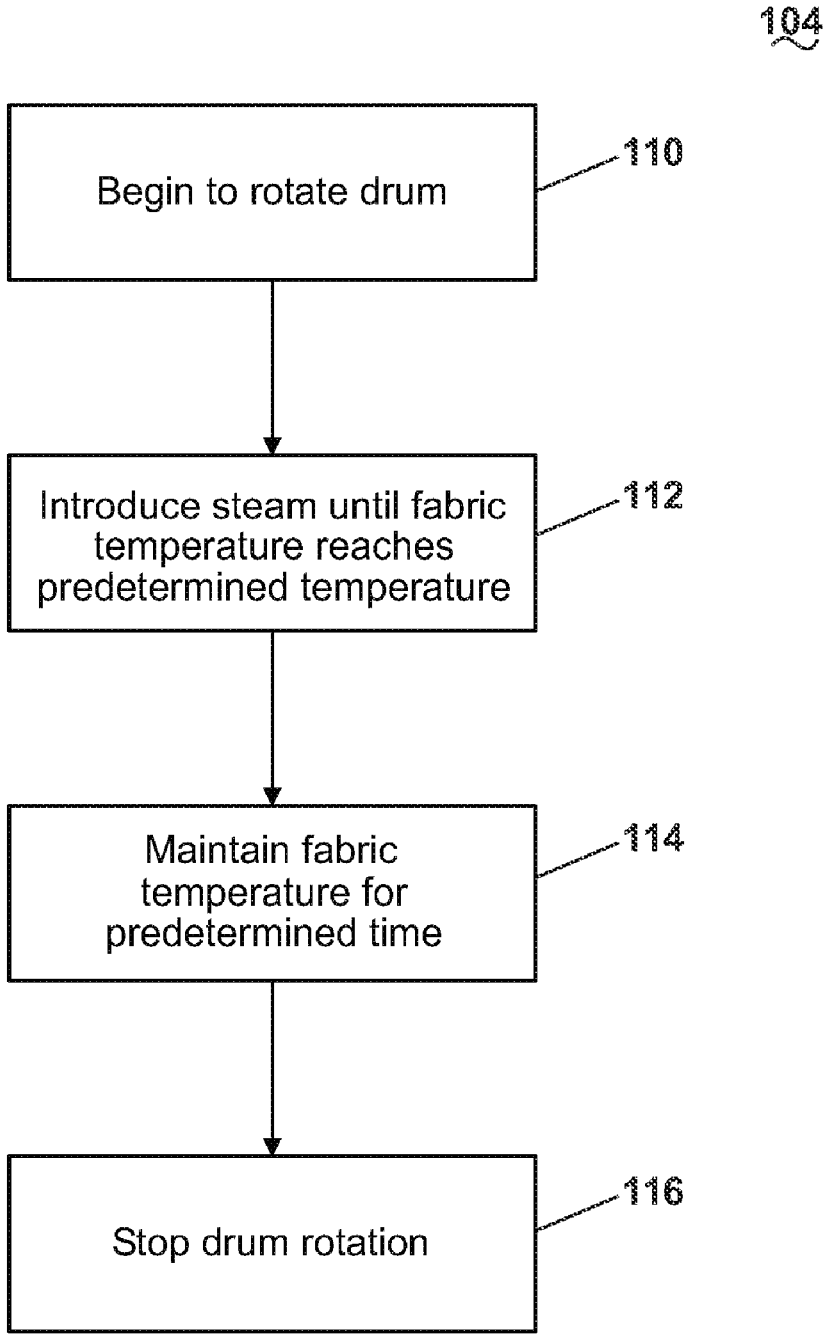
FIG. 3 is a flow chart of the sanitization step of FIG. 2 according to one embodiment of the invention.
Figure 4:
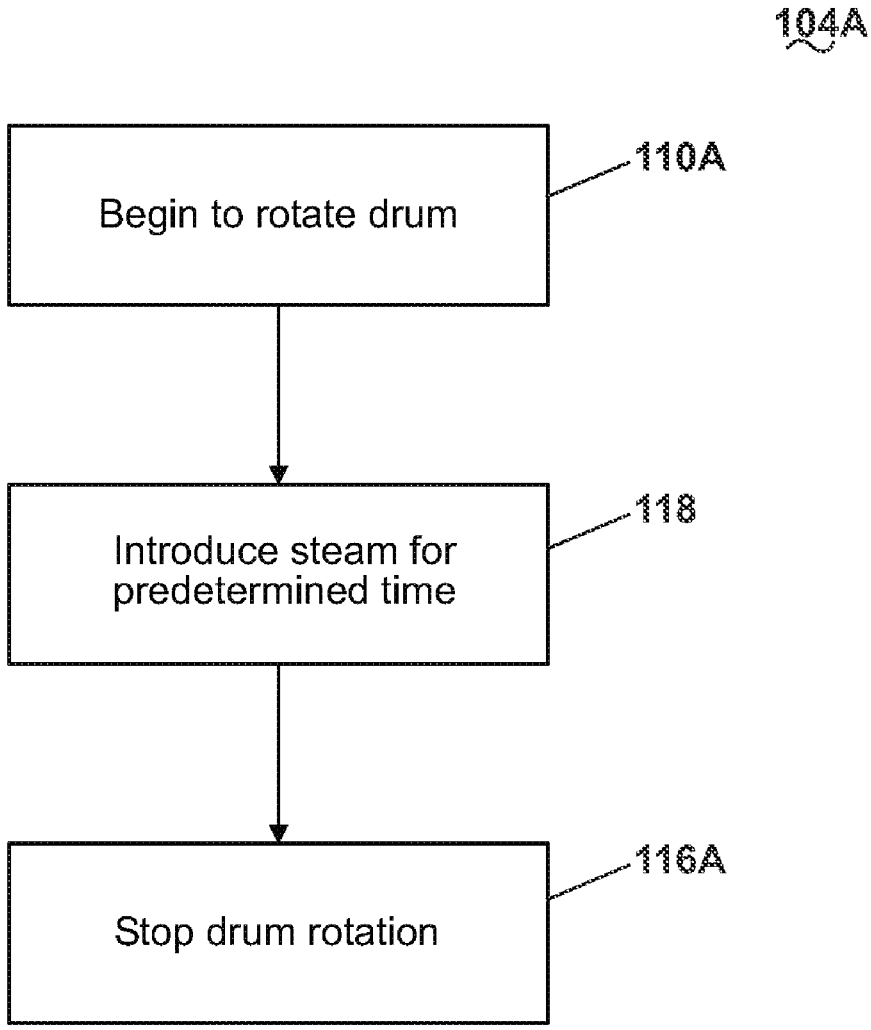
FIG. 4 is a flow chart of the sanitization step of FIG. 2 according to another embodiment of the invention.

As stated above, the sanitization step 104 can be any suitable process that accomplishes sanitization of the fabric items with steam, and an alternative to the exemplary sanitization step 104 of FIG. 3 is shown in FIG. 4, where elements similar to those of the sanitization step 104 of FIG. 3 are identified with the same reference number bearing the letter "A."

The exemplary alternative sanitization step 104A initiates with rotating the drum in step 110A, such as at a tumbling speed in one direction or alternating directions. Either after or when the drum 16 begins to rotate, steam is introduced into the tub 14 and/or the drum 16, such as by the steam generator 60, in step 118. The introduction of steam in the step 118 continues for a predetermined time and can comprise continuously or intermittently introducing the steam. The predetermined time can be an empirically determined time and is preferably sufficiently long to accomplish a desired sanitization level of the fabric load. The predetermined time, therefore, inherently includes the fabric items reaching the sanitization temperature and can depend on several factors, including fabric type and load size. An exemplary range of suitable predetermined time is from about 5 minutes to about 15 minutes, and within this range, an exemplary suitable predetermined time has been determined to be about 10 minutes.

The drum 16 can continue to rotate during the step 118 of introducing the steam. The rotation of the drum 16 can be continuous, intermittent, in alternating directions, and/or in a single direction. After the predetermined time for introducing the steam expires, the drum rotation can cease immediately or after a period of time in step 116A.

Figure 5:
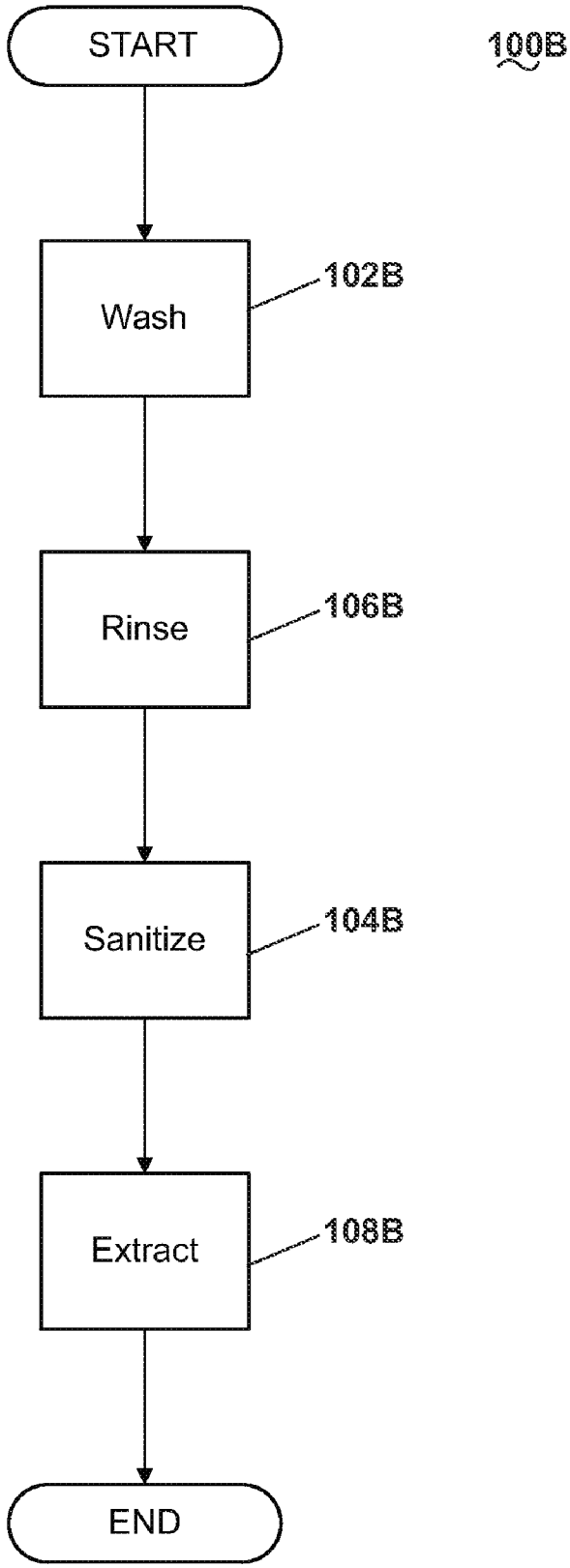
FIG. 5 is a flow chart of a method of operating the washing machine of FIG. 1 according to second embodiment of the invention.
Figure 6:
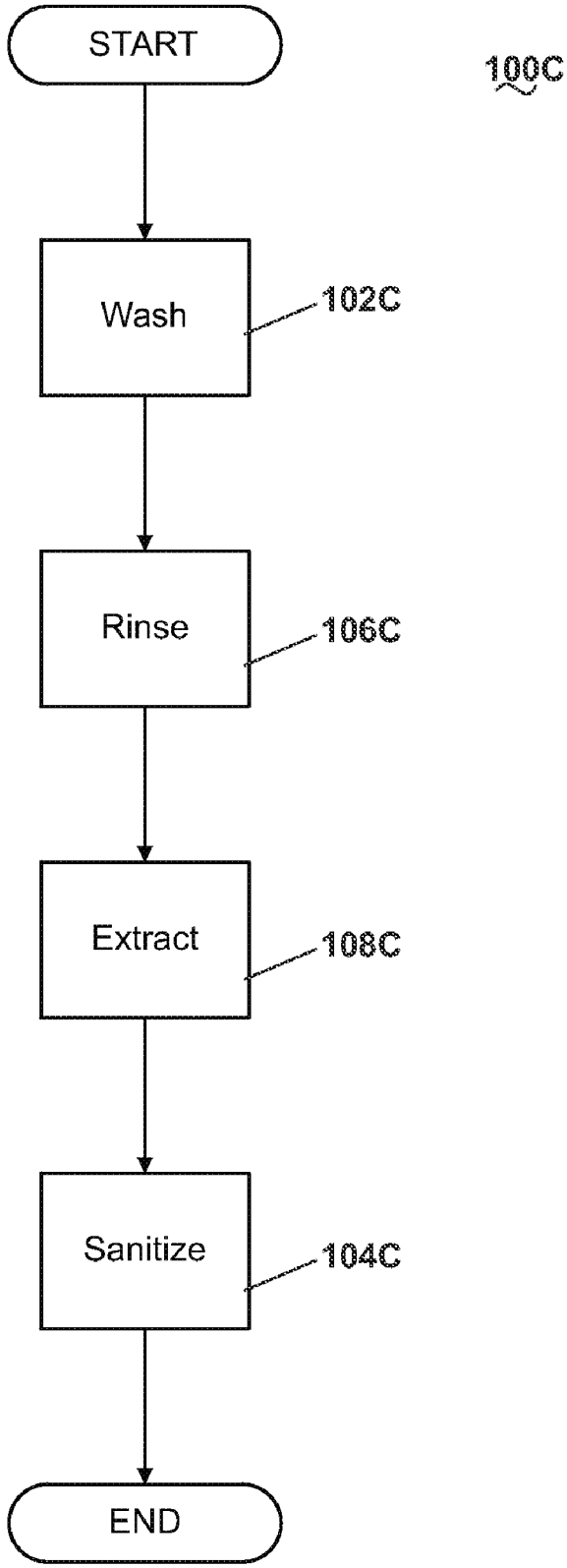
FIG. 6 is a flow chart of a method of operating the washing machine of FIG. 1 according to third embodiment of the invention.

Alternative examples of the method 100 shown in FIG. 2 are illustrated in the flow charts of FIGS. 5 and 6, where elements similar to those of the method 100 of FIG. 2 are identified with the same reference numeral bearing the letters "B" and "C," respectively.

Referring particularly to FIG. 5, the alternative method 100B is substantially the same as the method 100, except that the sanitization step 104B occurs after the rinse step 106B in the method 100B rather than between the wash step 102 and the rinse step 106, as in the method 100. Because the sanitization step 104B follows the rinse step 106B, the rinse step 106B, according to one embodiment, comprises subjecting the fabric items to heated rinse liquid, such as water, to raise the temperature of the fabric items above ambient temperature prior to the sanitization step 104B. The liquid from the wash step 102B can also be, but is not required to be, heated to facilitate increasing the temperature of the fabric items prior to the sanitization step 104B.

Referring now to FIG. 6, the alternative method 100C is substantially the same as the method 100, except that the sanitization step 104C occurs after the extraction step 108C in the method 100C rather than between the wash step 102 and the rinse step 106, as in the method 100. Optionally, the rinse step 106C and/or the wash step 102C can include subjecting the fabric items to heated liquid to raise the temperature of the fabric items above ambient temperature prior to the sanitization step 104C.

By performing the sanitization step 104C at the end of the method 100C, the fabric load is heated when the user removes the fabric load from the washing machine 10, thereby providing the user a warm feel at the end of the wash cycle. Alternatively, the warm feel can be provided by simply heating the fabric load with steam at the end of the wash cycle, such as during the extraction step or after the extraction step. When the steam is introduced after the extraction step, the drum 16 can rotate, such as at a tumbling speed, while during the steam introduction.

The exemplary embodiments of the method 100, 100B, 100C have been described as including the wash step 102, 102B, 102C, the rinse step 106, 106B, 106C, and the extraction step 108, 108B, 108C. However, it is within the scope of the invention for the methods 100, 100B, 100C to include only one or a subset of the wash, rinse, and extraction steps. Furthermore, it is contemplated that other steps, such as a pre-wash step, can be included in the methods 100, 100B, 100C. The sanitization step 104, 104A can also be executed as a stand-alone step rather than in the context of a wash cycle. When used as a stand-alone step, the sanitization step 104, 104A can be conducted following input of a user command to begin the sanitization step 104, 104A.

In addition to sanitizing the fabric items with heat, the sanitization step 104, 104A can include introducing a sanitizing agent or chemical into the tub 14 and/or drum 16 to facilitate the sanitization process. The sanitizing agent can be any suitable agent, and examples of the sanitizing agent include, but are not limited to, chlorine, chloramines, chlorine dioxide, alcohols, hydrogen peroxide, ozone, phenol and other phenolics, quaternary ammonium salts, and hypochlorites (e.g., sodium hypochlorite).

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of operating a fabric treatment appliance comprising at least one of a tub and drum configured to hold a fabric load, the method comprising:

washing the fabric load including an application of heated liquid to the fabric load;

after the washing of the fabric load, draining the heated liquid that is not retained by the fabric load from the at least one of the tub and drum;

before extracting of the heated liquid retained by the fabric load by spinning the drum and after the draining of the heated liquid, sanitizing the fabric load by heating the fabric load with steam to a sanitizing temperature and maintaining the fabric load at or above the sanitizing temperature for a sanitizing time period sufficient to sanitize the fabric load; and extracting the heated liquid retained by the fabric load by spinning the drum.

2. The method of claim 1 wherein the sanitizing of the fabric load comprises increasing a temperature of the fabric load to a predetermined temperature.

3. The method of claim 2 wherein the predetermined temperature is about 70° C.

4. The method of claim 2 wherein the sanitizing of the fabric load further comprises maintaining the temperature of the fabric load at the predetermined temperature for a predetermined time.

5. The method of claim 4 wherein the predetermined time is about 10 minutes.

6. The method of claim 1 wherein the sanitizing of the fabric load comprises heating the fabric load for a predetermined time.

7. The method of claim 6 wherein the predetermined time is about 30 minutes.

8. The method of claim 1 wherein the sanitizing of the fabric load comprises rotating the at least one of the tub and drum.

9. The method of claim 8 wherein the rotating of the at least one of the tub and drum occurs during an introduction of steam into the at least one of the tub and drum.

10. The method of claim 8 wherein the rotating the at least one of the tub and drum comprises tumbling the fabric load.

11. The method of claim 10 wherein the tumbling of the fabric load comprises tumbling the fabric load in alternating directions.

12. The method of claim 1 wherein the sanitizing of the fabric load comprises subjecting the fabric load to a sanitizing agent.

13. The method of claim 1 wherein the heated liquid comprises water and detergent.

14. The method of claim 13, further comprising rinsing the fabric load with rinse liquid after the sanitizing of the fabric load.

15. The method of claim 14, further comprising extracting the rinse liquid from the fabric load.

16. The method of claim 1 wherein the heated liquid comprises rinse water.

17. The method of claim 1 wherein the heated liquid has a temperature within a range of about 25° C. to about 60° C.

18. The method of claim 17 wherein the heated liquid temperature is about 40° C.

19. The method of claim 1 wherein an initial heating of the fabric load by the application of heated liquid to the fabric load comprises heating the fabric load to a first temperature above ambient temperature.

20. The method of claim 19 wherein the sanitizing of the fabric load comprises heating the fabric load to a sanitization temperature greater than the first temperature.

21. The method of claim 20 wherein the sanitizing of the fabric load further comprises maintaining the sanitization temperature for a predetermined time.

22. The method of claim 1, further comprising rinsing the fabric load with rinse liquid after the sanitizing of the fabric load and before an extracting of liquid from the fabric load by spinning the drum.

* * * * *